US007617049B2

(12) United States Patent
McElhinney et al.

(10) Patent No.: US 7,617,049 B2
(45) Date of Patent: Nov. 10, 2009

(54) DISTANCE DETERMINATION FROM A MAGNETICALLY PATTERNED TARGET WELL

(75) Inventors: Graham McElhinney, Inverarie (GB); Herbert M. J. Illfelder, Houston, TX (US)

(73) Assignee: Smith International, Inc., Houston, TX (US)

( * ) Notice: Subject to any disclaimer, the term of this patent is extended or adjusted under 35 U.S.C. 154(b) by 133 days.

(21) Appl. No.: 11/799,906

(22) Filed: May 3, 2007

(65) Prior Publication Data

US 2008/0177475 A1 Jul. 24, 2008

Related U.S. Application Data

(60) Provisional application No. 60/881,895, filed on Jan. 23, 2007.

(51) Int. Cl.
*G06F 3/00* (2006.01)

(52) U.S. Cl. ..... 702/6; 702/9; 702/14; 702/179

(58) Field of Classification Search ..... 702/6, 702/7, 9, 127, 150, 158, 189; 166/250.01; 175/45, 61, 63; 335/284
See application file for complete search history.

(56) References Cited

U.S. PATENT DOCUMENTS 3,725,777 A 4/1973 Robinson et al.
4,072,200 A 2/1978 Morris et al.
4,458,767 A 7/1984 Hoehn, Jr.
4,465,140 A 8/1984 Hoehn, Jr.
5,148,869 A * 9/1992 Sanchez ..... 166/303
5,230,387 A 7/1993 Waters et al.
5,485,089 A 1/1996 Kuckes
5,512,830 A 4/1996 Kuckes
5,541,517 A 7/1996 Hartmann et al.
5,589,775 A * 12/1996 Kuckes ..... 324/346

(Continued)

FOREIGN PATENT DOCUMENTS

EP 0 301 671 B1 2/1989

(Continued)

OTHER PUBLICATIONS

A. G. Nekut, A. F. Kuckes, and R. G. Pitzer, "Rotating Magnet Ranging—a new drilling guidance technology," 8th One Day Conference on Horizontal Well Technology, Canadian Sections SPE/Petroleum Society, Nov. 7, 2001.

(Continued)

*Primary Examiner*—Eliseo Ramos Feliciano
*Assistant Examiner*—Felix E Suarez

(57) ABSTRACT

Methods for determining the distance and relative axial position between twin and target wells are disclosed. In one exemplary embodiment the magnitude and direction of the interference magnetic field vector are processed to determine the distance and the axial position. In another exemplary embodiment, a change in direction of the interference magnetic field vector between first and second longitudinally spaced magnetic field measurements may be processed to determine the distance and axial position. In still another exemplary embodiment of the invention, a component of the magnetic field vector aligned with the tool axis may be measured in substantially real time during drilling and utilized to determine the distance between the two wells. Embodiments of this invention improve the accuracy and/or the frequency of distance determination between twin and target wells.

24 Claims, 7 Drawing Sheets

U.S. PATENT DOCUMENTS

| | | | | |
|---|---|---|---|---|
| 5,657,826 | A | 8/1997 | Kuckes | |
| 5,675,488 | A * | 10/1997 | McElhinney | 702/10 |
| 5,923,170 | A | 7/1999 | Kuckes | |
| 6,369,679 | B1 | 4/2002 | Cloutier et al. | |
| 6,698,516 | B2 | 3/2004 | Towle et al. | |
| 6,937,023 | B2 * | 8/2005 | McElhinney | 324/347 |
| 6,985,814 | B2 * | 1/2006 | McElhinney | 702/7 |
| 6,991,045 | B2 | 1/2006 | Vinegar et al. | |
| 2004/0119607 | A1 | 6/2004 | Davies et al. | |
| 2006/0131013 | A1 | 6/2006 | McElhinney | |

FOREIGN PATENT DOCUMENTS

| | | |
|---|---|---|
| WO | WO 95/19400 | 7/1995 |

OTHER PUBLICATIONS

W-D Coils brochure by Western Instruments, published Mar. 2001: http://www.westerninstruments.com/portableMPI/coils/WD_COI_1.jpg, http://www.westerninstruments.com/portableMPI/coils/WD_COI_2.gif, and http://www.westerninstruments.com/portableMPI/coils/WD_COI_3.gif.

J.I. de Lance and T.J. Darling, "Improved detectability of blowing wells," SPE Drilling Engineering, Mar. 1990.

T.L. Grills, "Magnetic ranging technologies for drilling steam assisted gravity drainage well pairs and unique well geometries—A comparison of Technologies," SPE/Petroleum Society of CIM/CHOA 79005, 2002.

* cited by examiner

DISTANCE DETERMINATION FROM A MAGNETICALLY PATTERNED TARGET WELL

RELATED APPLICATIONS

This application claims the benefit of U.S. Provisional Application Ser. No. 60/881,895 entitled Distance Determination From A Magnetically Patterned Target Well, filed Jan. 23, 2007.

FIELD OF THE INVENTION

The present invention relates generally to drilling and surveying subterranean boreholes such as for use in oil and natural gas exploration. In particular, this invention relates to methods for determining a distance between a twin well and a magnetized target well.

BACKGROUND OF THE INVENTION

The use of magnetic field measurements in prior art subterranean surveying techniques for determining the direction of the earth's magnetic field at a particular point is well known. Techniques are also well known for using magnetic field measurements to locate subterranean magnetic structures, such as a nearby cased borehole. These techniques are often used, for example, in well twinning applications in which one well (the twin well) is drilled in close proximity and often substantially parallel to another well (commonly referred to as a target well).

The magnetic techniques used to sense a target well may generally be divided into two main groups; (i) active ranging and (ii) passive ranging. In active ranging, the local subterranean environment is provided with an external magnetic field, for example, via a strong electromagnetic source in the target well. The properties of the external field are assumed to vary in a known manner with distance and direction from the source and thus in some applications may be used to determine the location of the target well. In contrast to active ranging, passive ranging techniques utilize a preexisting magnetic field emanating from magnetized components within the target borehole. In particular, conventional passive ranging techniques generally take advantage of magnetization present in the target well casing string. Such magnetization is typically residual in the casing string because of magnetic particle inspection techniques that are commonly utilized to inspect the threaded ends of individual casing tubulars.

In co-pending, commonly assigned, U.S. patent application Ser. No. 11/301,762 to McElhinney, a technique is disclosed in which a predetermined magnetic pattern is deliberately imparted to a plurality of casing tubulars. These tubulars, thus magnetized, are coupled together and lowered into a target well to form a magnetized section of casing string typically including a plurality of longitudinally spaced pairs of opposing magnetic poles. Passive ranging measurements of the magnetic field may then be advantageously utilized to survey and guide drilling of a twin well relative to the target well. For example, the distance between the twin and target wells may be determined from magnetic field strength measurements made in the twin well. This well twinning technique may be used, for example, in steam assisted gravity drainage (SAGD) applications in which horizontal twin wells are drilled to recover heavy oil from tar sands.

While the above described method of magnetizing wellbore tubulars has been successfully utilized in well twinning applications, there is room for yet further improvement. For example, it has been found that the above described longitudinal magnetization method can result in a somewhat non-uniform magnetic flux density along the length of a casing string at distances of less than about 6-8 meters. If unaccounted, the non-uniform flux density can result in distance errors on the order of about ±1 meter when the distance between the two wells is about 5-6 meters. While such distance errors are typically within specification for most well twinning operations, it would be desirable to improve the accuracy of distance calculations between the target and twin wells.

Moreover, passive ranging surveys are typically acquired at about 10 meter intervals along the length of the twin well. More closely spaced distance measurements may sometimes be advantageous (or even required) to accurately place the twin well. For example, more frequent distance measurements would be advantageous during an approach (also referred to in the art as a landing) or during a period of unusual drift in either the target or twin well. Taking more frequent magnetic surveys is undesirable since each magnetic survey requires a stoppage in drilling (and is therefore costly in time).

Therefore, there exists a need for improved methods for determining the distance between a twin well and a magnetically patterned target well. In particular, there is a need for a method that accounts for fluctuations in magnetic field strength and thereby improves the accuracy of the determined distances. There is also a need for a dynamic distance measurement method (i.e., a method for determining the distance between that does not require a stoppage in drilling).

SUMMARY OF THE INVENTION

Exemplary aspects of the present invention are intended to address the above described need for improved methods for determining the distance between a twin well and a magnetized target well. In one exemplary embodiment, the invention includes processing the strength of the interference magnetic field and a variation in the field strength along the longitudinal axis of the target well to determine the distance to the target well. In another exemplary embodiment of the invention, measurement of the component of the magnetic field vector aligned with the tool axis may be acquired while drilling and utilized to determine the distance between the two wells in substantially real time. Still other exemplary embodiments of the invention enable both the distance between the twin and target wells and the axial position of the magnetic sensors relative to the target well to be determined. In one of these exemplary embodiments the magnitude and direction of the interference magnetic field vector are processed to determine the distance and the axial position. In another of these exemplary embodiments, the change in direction of the interference magnetic field vector between first and second longitudinally spaced magnetic field measurements may be processed to determine the distance and axial position.

Exemplary embodiments of the present invention provide several advantages over prior art well twinning and distance determination methods. For example, exemplary embodiments of this invention improve the accuracy of distance calculations between twin and target wells. Such improvements in accuracy enable a drilling operator to position a twin well with increased accuracy relative to the target well. Moreover, exemplary embodiments of the invention also enable the distance between the twin and target wells to be determined in substantially real time. These real-time distances may be used, for example, to make real-time steering decisions. Moreover, exemplary embodiments of this invention also enable the axial position of the magnetic sensors relative to the target well to be determined.

In one aspect, the present invention includes a method for determining the distance between a twin well and a target well, the target well being magnetized such that it includes a substantially periodic pattern of opposing north-north (NN) magnetic poles and opposing south-south (SS) magnetic poles spaced apart along a longitudinal axis thereof. The method includes deploying a drill string in the twin well, the drill string including a magnetic sensor in sensory range of magnetic flux emanating from the target well and measuring a magnetic field with the magnetic sensor. The method further includes processing the measured magnetic field to determine a magnitude of an interference magnetic field attributable to the target well and processing the magnitude of the interference magnetic field to determine a first distance to the target well. The method also includes estimating an axial position of the magnetic sensor relative to at least one of the opposing magnetic poles imparted to the target well and processing the first distance in combination with the estimated axial position to determine a second distance to the target well.

In another aspect, this invention includes a method for estimating the distance between a twin well and a magnetized target well in substantially real time during drilling of the twin well. The target well is magnetized such that it includes a substantially periodic pattern of opposing north-north (NN) magnetic poles and opposing south-south (SS) magnetic poles spaced apart along a longitudinal axis thereof. The method includes deploying a drill string in the twin well, the drill string including a magnetic sensor in sensory range of magnetic flux emanating from the target well and measuring an axial component of the magnetic flux in substantially real time during drilling, the axial component substantially parallel with a longitudinal axis of the twin well. The method further includes processing the measured axial component to estimate a magnitude of an interference magnetic field vector attributable to the target well and processing the estimated magnitude of the interference magnetic field vector to estimate the distance between the twin and target wells.

In still another aspect, this invention includes a method for determining a distance between a twin well and a target well, the target well being magnetized such that it includes a substantially periodic pattern of opposing north-north (NN) magnetic poles and opposing south-south (SS) magnetic poles spaced apart along a longitudinal axis thereof. The method includes deploying a drill string in the twin well, the drill string including a magnetic sensor in sensory range of magnetic flux emanating from the target well and measuring a magnetic field with the magnetic sensor. The method further includes processing the measured magnetic field to determine first and second components of an interference magnetic field vector attributable to the target well, the first and second components being selected from the group consisting of (i) a magnitude of the interference magnetic field vector and an angle of the interference magnetic field vector with respect to a fixed reference and (ii) magnitudes of first and second orthogonal components of the interference magnetic field vector. The method also includes processing the first and second components of the interference magnetic field vector in combination with a model relating the first and second components to (i) the distance and (ii) an axial position of the magnetic field sensor relative to the target well to determine the distance between the magnetic field sensor and the target well.

In yet another aspect this invention includes a method for determining a distance between a twin well and a target well, the target well being magnetized such that it includes a substantially periodic pattern of opposing north-north (NN) magnetic poles and opposing south-south (SS) magnetic poles spaced apart along a longitudinal axis thereof. The method includes deploying a drill string in the twin well, the drill string including a magnetic sensor in sensory range of magnetic flux emanating from the target well and measuring a magnetic field at first and second longitudinally spaced locations in the borehole. The method further includes processing the first and second magnetic field measurements to determine first and second directions of an interference magnetic field vector at the corresponding first and second locations and processing the first and second directions and a difference in measured depth between the first and second locations with a model relating a direction of the interference magnetic field vector to the distance between the twin well and the target well to determine the distance.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realize by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
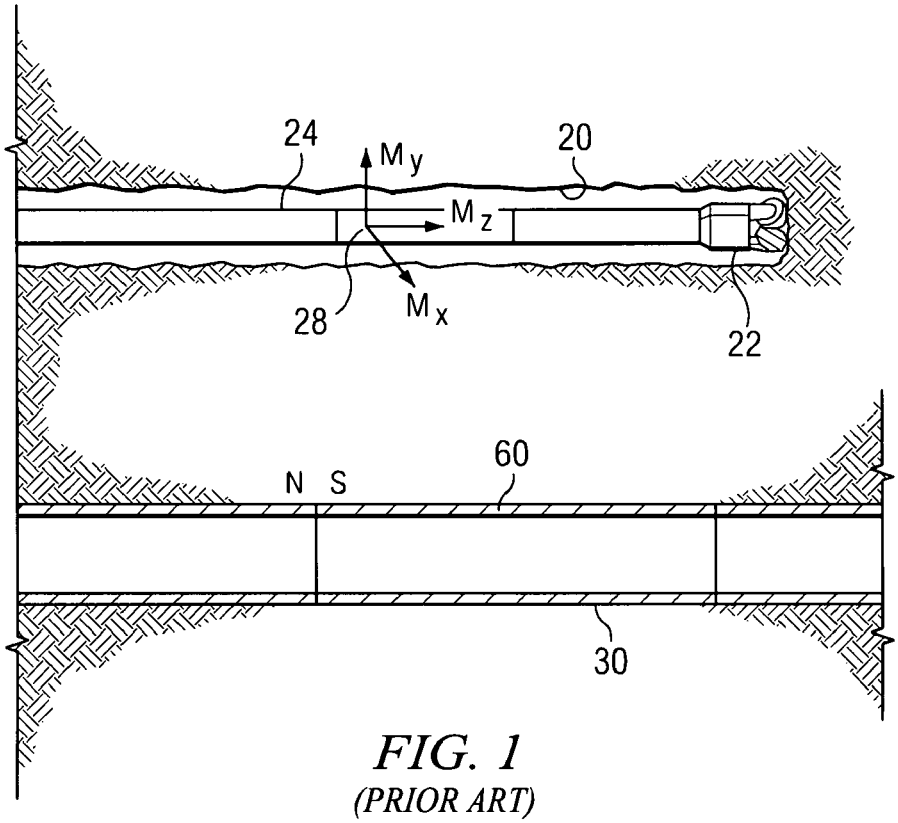
FIG. 1 (PRIOR ART)
FIG. 1 depicts a prior art arrangement for a SAGD well twinning operation.

FIG. 1 schematically depicts one exemplary embodiment of a well twinning application such as a SAGD twinning operation. Typical SAGD twinning operations require a horizontal twin well 20 to be drilled a substantially fixed distance substantially directly above a horizontal portion of the target well 30 (e.g., not deviating more than about 1-2 meters up or down or to the left or right of the lower well). In the exemplary embodiment shown, the lower (target) borehole 30 is drilled first, for example, using conventional directional drilling and MWD techniques. However, the invention is not limited in this regard. The target borehole 30 is then cased using a plurality of premagnetized tubulars (such as those shown on FIG. 2 described below). As described in co-pending, commonly assigned U.S. patent application Ser. No. 11/301,762, measurements of the magnetic field about the target well 30 may then be used to guide subsequent drilling of the twin well 20. In the embodiment shown, drill string 24 includes at least one tri-axial magnetic field measurement sensor 28 deployed in close proximity to the drill bit 22. Sensor 28 is used to passively measure the magnetic field about target well 30 as the twin well is drilled. Such passive magnetic field measurements are then utilized to guide continued drilling of the twin well 20 along a predetermined path relative to the target well 30. For example, as described in the '762 Application, the distance between the twin 20 and target 30 wells may be determined (and therefore controlled) via such magnetic field measurements.

Figure 2:
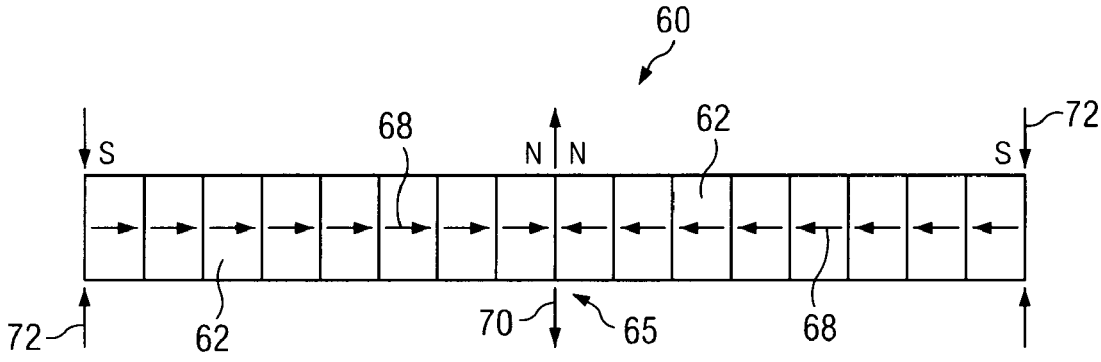
FIG. 2 (PRIOR ART)
FIG. 2 depicts a prior art magnetization of a wellbore tubular.

With reference now to FIG. 2, one exemplary tubular 60 magnetized as described in the '762 application is shown. The exemplary tubular 60 embodiment shown includes a plurality of discrete magnetized zones 62 (typically three or more). Each magnetized zone 62 may be thought of as a discrete cylindrical magnet having a north N pole on one longitudinal end thereof and a south S pole on an opposing longitudinal end thereof such that a longitudinal magnetic flux 68 is imparted to the tubular 60. Tubular 60 further includes a single pair of opposing north-north NN poles 65 at the midpoint thereof. The purpose of the opposing magnetic poles 65 is to focus magnetic flux outward from tubular 60 as shown at 70 (or inward for opposing south-south poles as shown at 72).

It will be appreciated that the present invention is not limited to the exemplary embodiments shown on FIGS. 1 and 2. For example, the invention is not limited to SAGD applications. Rather, exemplary methods in accordance with this invention may be utilized to drill twin wells having substantially any relative orientation for substantially any application. For example, embodiments of this invention may be utilized for river crossing applications (such as for underwater cable runs). Moreover, the invention is not limited to any particular magnetization pattern or spacing of pairs of opposing magnetic poles on the target well. The invention may be utilized for target wells having a longitudinal magnetization (e.g., as shown on FIG. 2) and/or a transverse magnetization (e.g., as disclosed in co-pending, commonly assigned U.S. patent application Ser. No. 10/536,124).

With continued reference to FIG. 1, exemplary embodiments of sensor 28 are shown to include three mutually orthogonal magnetic field sensors, one of which is oriented substantially parallel with the borehole axis ($M_Z$). Sensor 28 may thus be considered as determining a plane (defined by $M_X$ and $M_Y$) orthogonal to the borehole axis and a pole ($M_Z$) parallel to the borehole axis of the twin well, where $M_X$, $M_Y$, and $M_Z$ represent measured magnetic field vectors in the x, y, and z directions. As described in more detail below, exemplary embodiments of this invention may only require magnetic field measurements along the longitudinal axis of the drill string 24 ($M_Z$ as shown on FIG. 1).

The magnetic field about the magnetized casing string may be measured and represented, for example, as a vector whose orientation depends on the location of the measurement point within the magnetic field. In order to determine the magnetic field vector due to the target well (e.g., target well 30) at any point downhole, the magnetic field of the earth is typically subtracted from the measured magnetic field vector, although the invention is not limited in this regard. The magnetic field of the earth (including both magnitude and direction components) is typically known, for example, from previous geological survey data or a geomagnetic model. However, for some applications it may be advantageous to measure the magnetic field in real time on site at a location substantially free from magnetic interference, e.g., at the surface of the well or in a previously drilled well. Measurement of the magnetic field in real time is generally advantageous in that it accounts for time dependent variations in the earth's magnetic field, e.g., as caused by solar winds. However, at certain sites, such as an offshore drilling rig, measurement of the earth's magnetic field in real time may not be practical. In such instances, it may be preferable to utilize previous geological survey data in combination with suitable interpolation and/or mathematical modeling (i.e., computer modeling) routines.

The earth's magnetic field at the tool and in the coordinate system of the tool may be expressed, for example, as follows:

$$M_{EX}=H_E(\cos D \sin Az \cos R+\cos D \cos Az \cos Inc \sin R-\sin D \sin Inc \sin R)$$

$$M_{EY}=H_E(\cos D \cos Az \cos Inc \cos R+\sin D \sin Inc \cos R-\cos D \sin Az \sin R)$$

$$M_{EZ}=H_E(\sin D \cos Inc-\cos D \cos Az \sin Inc) \qquad \text{Equation 1}$$

where $M_{EX}$, $M_{EY}$, and $M_{EZ}$ represent the x, y, and z components, respectively, of the earth's magnetic field as measured at the downhole tool, where the z component is aligned with the borehole axis, $H_E$ is known (or measured as described above) and represents the magnitude of the earth's magnetic field, and D, which is also known (or measured), represents the local magnetic dip. Inc, Az, and R represent the Inclination, Azimuth (relative to magnetic north) and Rotation (also known as the gravity tool face), respectively, of the tool, which may be obtained, for example, from conventional surveying techniques. However, as described above, magnetic azimuth determination can be unreliable in the presence of magnetic interference. In such applications, where the measured borehole and the target borehole are essentially parallel (i.e., within five or ten degrees of being parallel), Az values from the target well, as determined, for example in a historical survey, may be utilized.

The magnetic field vectors due to the target well (also referred to as interference vectors in the art) may then be represented as follows:

$$M_{TX}=M_X-M_{EX}$$

$$M_{TY}=M_Y-M_{EY}$$

$$M_{TZ}=M_Z-M_{EZ} \qquad \text{Equation 2}$$

where $M_{TX}$, $M_{TY}$, and $M_{TZ}$ represent the x, y, and z components, respectively, of the interference magnetic field vector due to the target well and $M_X$, $M_Y$, and $M_Z$, as described above, represent the measured magnetic field vectors in the x, y, and z directions, respectively.

The artisan of ordinary skill will readily recognize that in determining magnetic field vectors about the target well it may also be necessary to subtract other magnetic field components from the measured magnetic field vectors. For example, such other magnetic field components may be the result of drill string, steering tool, and/or drilling motor interference. Techniques for accounting for such interference are well known in the art. Moreover, magnetic interference may emanate from other nearby cased boreholes. In SAGD applications in which multiple sets of twin wells are drilled in close proximity, it may be advantageous to incorporate the magnetic fields of the various nearby wells into a mathematical model.

The magnetic field strength due to the target well may be represented, for example, as follows:

$$M=\sqrt{M_{TX}^2+M_{TY}^2+M_{TZ}^2} \quad \text{Equation 3}$$

where M represents the magnetic field strength due to the target well (also referred to herein as the interference magnetic field strength) and $M_{TX}$, $M_{TY}$, and $M_{TZ}$ are defined above with respect to Equation 2. The magnetic field strength, M, is sometimes also referred to equivalently in the art as the total magnetic field (TMF) and/or the magnetic flux density. As disclosed in the '762 Patent Application, the measured magnetic field strength, M, may be utilized to determine the distance between twin and target wells. For example, the magnetic field strength, M, was disclosed to decrease with increasing distance.

Improved Distance Calculation

Figure 3:
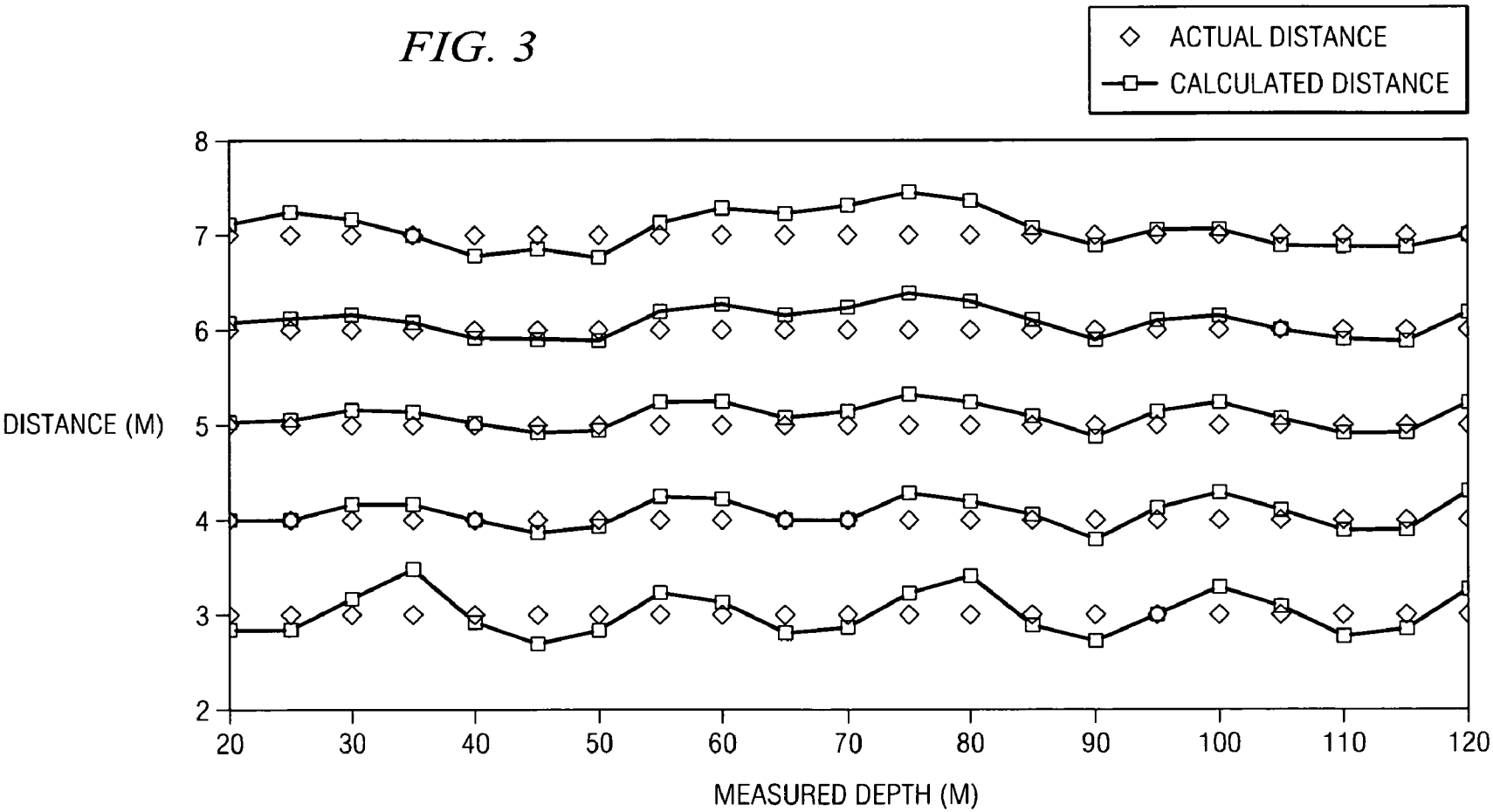
FIG. 3 depicts a plot of distance versus measured depth for a surface test.

With reference now to FIG. 3, actual and calculated distances are plotted as a function of measured depth for a surface test. The calculated distances were determined from an empirically based falloff equation assuming an exponential decrease in the magnetic field strength, M, with increasing distance. Measurements were made at distances ranging from 3 to 7 meters. FIG. 3 shows an approximately periodic variation in the calculated distance as a function of measured depth (along the longitudinal axis of the target). The calculated distances shown on FIG. 3, are all within about 15% of the actual distances. This is within the specifications for typical well twinning applications (such as SAGD applications). Notwithstanding, it would be advantageous to improve the accuracy of the calculated distances and in particular true move the above described periodic variations.

The above-described variation in the calculated distance is due to an approximately periodic variation in the magnetic field strength along the axis of the target well. It has been observed that the magnetic field strength is greater at locations adjacent pairs of opposing magnetic poles than at locations between the pairs of opposing poles (resulting in smaller calculated distances adjacent the pairs of opposing poles than between adjacent pairs). As described above, the calculated distances shown on FIG. 3 are determined via an empirically based logarithmic falloff equation. An equation of the following form has been found to work well with both slotted and non-slotted tubulars commonly used in SAGD operations:

$$d_1=a\ \ln(M)+b \quad \text{Equation 4}$$

where $d_1$ represents the distance between the two wells, M represents the magnetic field strength (e.g., as determined in Equation 3), and a and b represent empirical fitting parameters.

Figure 4:
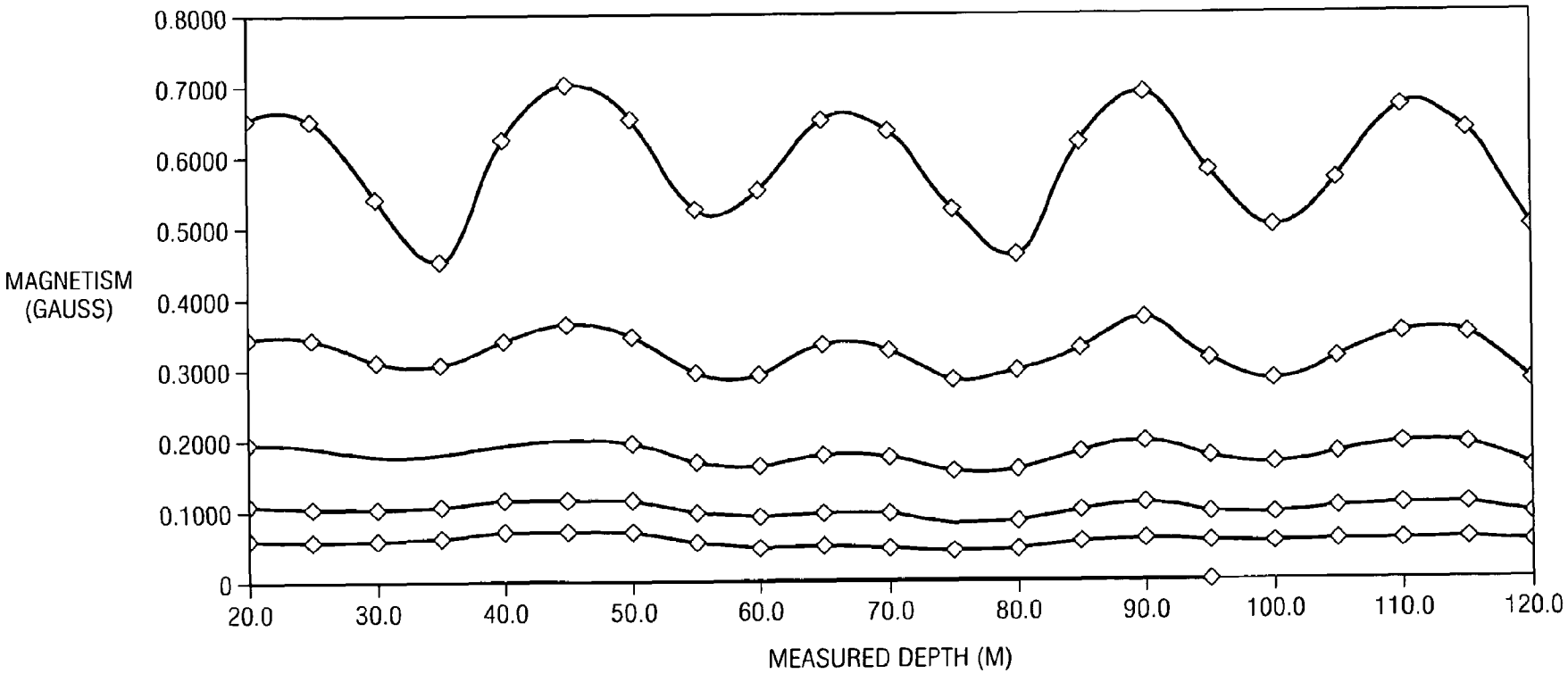
FIG. 4 depicts a plot of magnetic field strength versus measured depth for the surface test of FIG. 3.

With reference to FIG. 4, magnetic field strength is plotted as a function of measured depth for the surface test described above with respect to FIG. 3. As shown, the magnetic field strength is approximately periodic with measured depth, with the amplitude of the variation decreasing significantly with increasing distance to the target well. The amplitude of the variation as a function of distance may be described mathematically, for example, via a fourth order polynomial equation of the following form:

$$A=sd_1^4+td_1^3+ud_1^2+vd_1+w \quad \text{Equation 5}$$

where A represents the amplitude of the variation of the magnetic field along the longitudinal axis, $d_1$ represents the distance between the measurement point and the target well, and s, t, u, v, and w represent empirically derived fitting parameters.

In one exemplary embodiment of the present invention, the distance between twin and target wells may be calculated with improved accuracy if the axial position of the sensors 28 (FIG. 1) with respect to the target well (in particular with respect to the pairs of opposing magnetic poles) is known. The axial position of the sensors may be determined, for example, by monitoring the variation of various components, such as the axial component $M_Z$. In a preferred embodiment $M_Z$ (or $M_{TZ}$) is measured in real time during drilling and telemetered (e.g., via mud pulse telemetry) to the surface at some suitable interval (e.g., one or two data points per minute). The axial position of sensor 28 (FIG. 1) along the target well may be determined from these substantially real-time magnetic field measurements in any number of suitable ways. The individual components of the interference magnetic field vector (e.g., $M_{TZ}$) are periodic along the axis of the target well due to the periodic nature of the casing string magnetization (i.e., due to the repeating pairs of opposing magnetic poles). In the exemplary embodiment shown on FIG. 2, the period (the distance between adjacent opposing NN poles) is equal to the length of a single casing tubular (although the invention is not limited to any particular period length). $M_{TZ}$ is maximum and minimum at axial positions between adjacent pairs of opposing poles and approximately zero at positions adjacent pole pairs (NN and SS pole pairs).

In accordance with one exemplary embodiment of the present invention, the distance between twin and target wells may be determined as follows:

1. Determine the interference magnetic field strength.
2. Estimate the distance between the twin and target wells from the interference magnetic field strength, for example, via Equation 4.
3. Estimate the amplitude of the variation of the interference magnetic field strength along the longitudinal axis at the distance estimated in step 2, for example, using Equation 5.
4. Determine the axial position of the magnetic field sensor deployed in the twin well with respect to the pairs of opposing magnetic poles imparted to the target well, for example, using substantially real time measurements of the axial component of the magnetic field as described above.
5. Determine the local amplitude of the magnetic field variation along the axis (the amplitude of the variation at the axial position determined in step 4), for example, according to an equation of the form: $\Delta M=A \sin \theta$, where $\Delta M$ represents the local amplitude, A represents the amplitude determined in step 3, and $\theta$ represents the axial position of the sensors with respect to the target (e.g., as a phase angle where $\theta=0$ degrees represents a NN opposing pole and $\theta=180$ degrees represents a SS opposing pole).
6. Correct the measured interference magnetic field strength to remove the local amplitude determined in step 5, for example, as follows: $M_2=M-\Delta M$, where $M_2$ represents the corrected interference magnetic field strength.
7. Recalculate the distance to the target well using the corrected interference magnetic field strength from step 6, for example, using Equation 4 as follows: $d_2=a\ \ln(M_2/M_0)$, where $d_2$ represents the corrected distance.

In step 5, the variation of the magnetic field strength along the axis is assumed to be sinusoidal. It will be appreciated that the invention is not limited to any particular periodic function. Other suitable periodic functions (e.g., a triangular wave function) may also be utilized.

Estimation of Distance in Substantially Real Time

Substantially real-time measurements of the axial component of the magnetic field $M_Z$ (or of the interference magnetic field vector, $M_{TZ}$) may also be utilized to provide a substantially real-time estimate of the distance between the twin and target wells during drilling (i.e., stoppage not required). For example, the interference magnetic field strength, M, may be estimated graphically as shown on FIG. 5, which plots the axial component of the magnetic field $M_Z$ versus measured depth for SAGD well twinning operation. The interference magnetic field strength, M, is approximately equal to half of the peak to trough amplitude $M_Z$. It will be appreciated that M may be substituted into Equation 4 to obtain a substantially real time estimate of the distance between the two wells. With respect to FIG. 5B, note that the distance to the target well is increasing with increasing measured depth as indicated by the decreasing peak to trough amplitude with increasing measured depth, thereby indicating a of the direction of drilling of the twin well relative to the target well. The artisan of ordinary skill in the art will readily recognize that the axial component of the interference magnetic field vector, $M_{TZ}$, may also be utilized. In applications in which the direction of drilling is substantially constant (straight ahead), $M_Z$ and $M_{TZ}$ may be equivalently utilized. In applications in which the drilling direction is changing (curved), the use of $M_{TZ}$ is preferred as the earth's magnetic field component (which changes with the changing borehole direction) has been removed (e.g., according to Equation 2).

The interference magnetic field strength, M, may also be estimated mathematically from the axial component of the interference magnetic field vector, $M_{TZ}$, and the axial position of the magnetic sensor, for example, as follows:

$$M = \frac{M_{TZ}}{\sin\theta} \qquad \text{Equation 6}$$

where θ represents the axial position of the sensors with respect to the target well, with θ=0 degrees representing a NN opposing pole and θ=180 degrees representing a SS opposing pole. In Equation 6, the periodic variation of $M_{TZ}$ along the axis of the target well is assumed to be approximately sinusoidal. It will be appreciated that the invention is not limited in this regard and that other periodic functions may be utilized. The distance to the target well may then be estimated, for example, by substituting M (estimated via FIG. 5 or Equation 6) into Equation 4. The magnetic field strength estimated in FIG. 5 or Equation 6 may also be in step 1 of the method described above.

Figure 5:
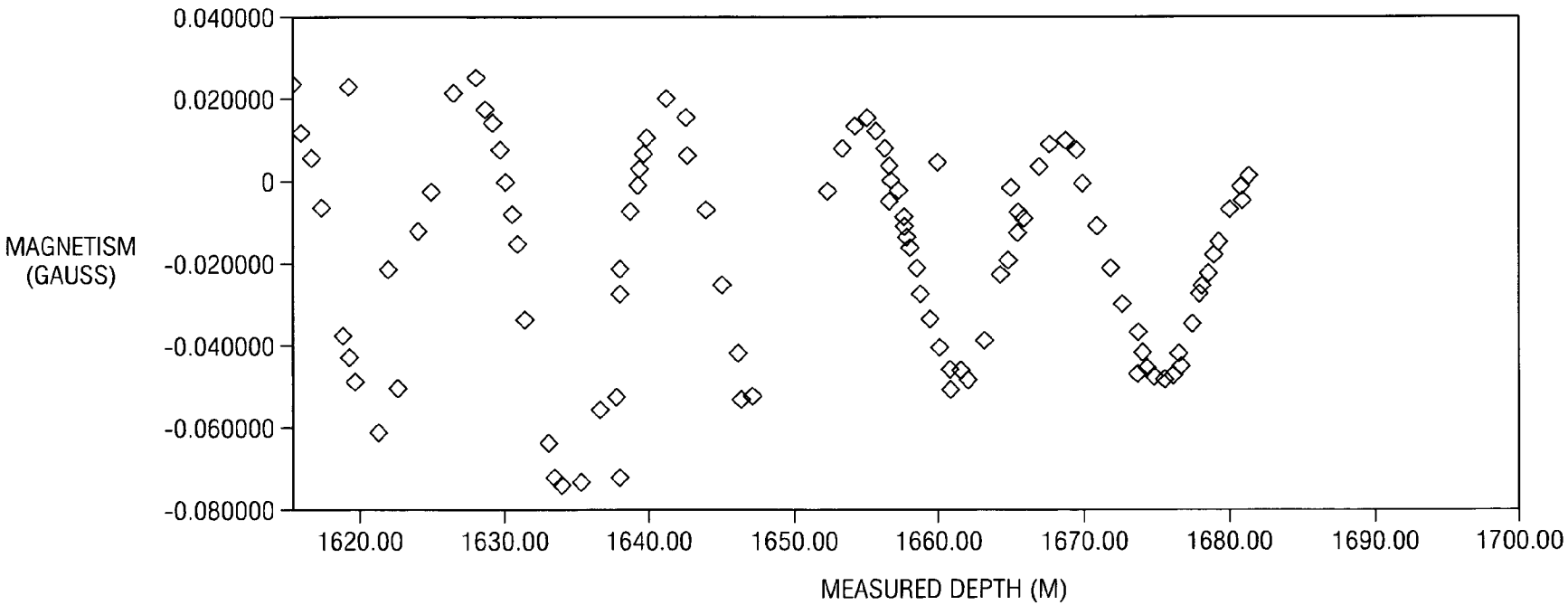
FIG. 5 depicts a plot of the axial component of the magnetic field as a function of measured depth for a well twinning operation.
Figure 6:
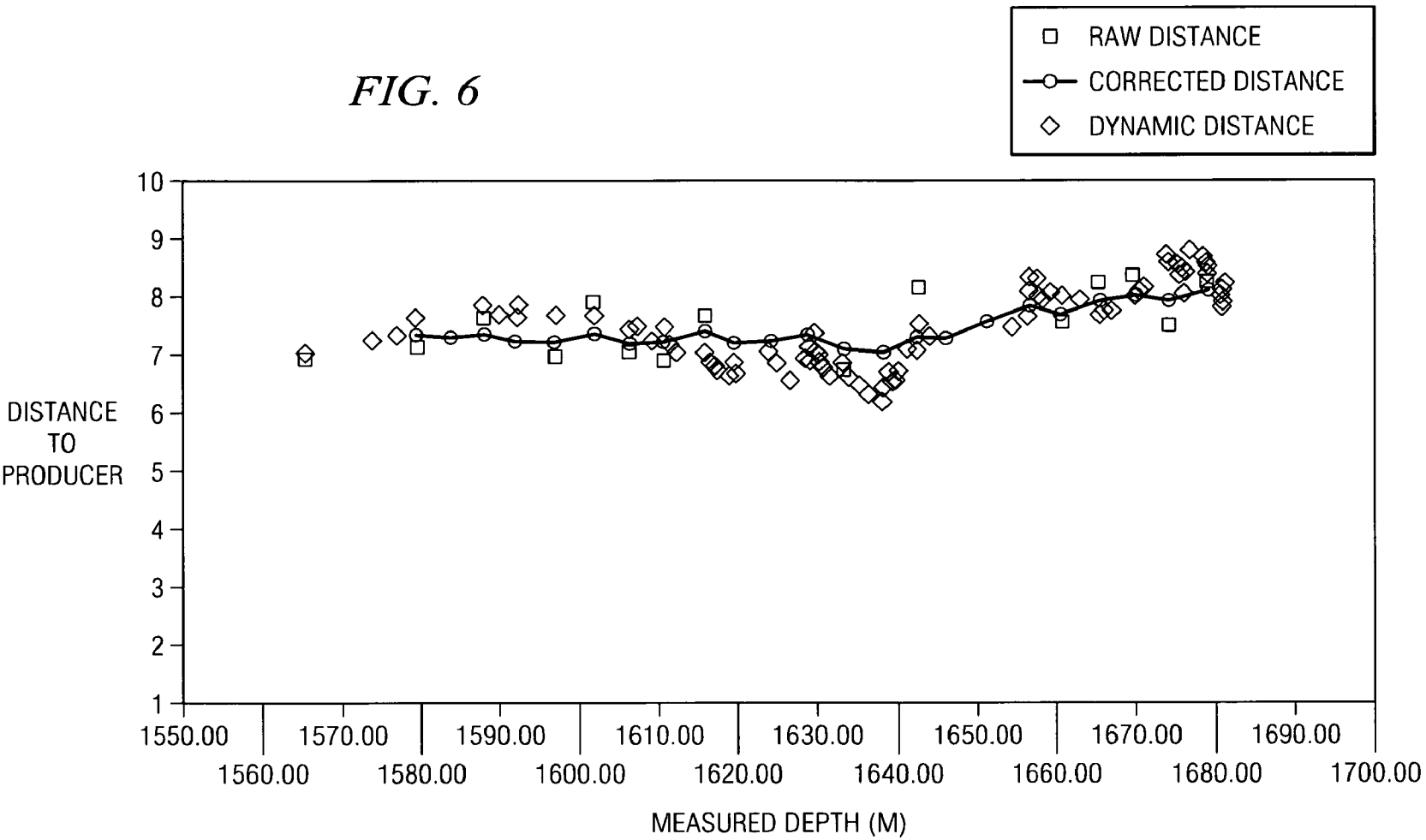
FIG. 6 depicts a plot of distance versus measured depth for the well twinning operation shown on FIG. 5.

With reference now to FIG. 6, the distance between twin and target wells is plotted as a function of measured depth for the same SAGD operation shown on FIG. 5. The distance is determined using three different methods. First the "raw" distance is determined from the interference magnetic field strength according to Equation 4. This method is similar to the method disclosed by McElhinney in the '762 Patent Application. Second, a "corrected" distance is determined using the exemplary method embodiment described above in steps 1 through 7. And third, a "dynamic" distance is determined using the substantially real time $M_{TZ}$ measurements described above. Note that the "corrected" distance has reduced noise as compared to the prior art "raw" distance clearly showing the increasing distance between the two wells beginning at a measured depth of about 1640 meters. The "dynamic" distance also provides a surprisingly accurate measurement of the distance and is expected to be suitable for controlling the distance between the two wells for most twinning applications. In fact the accuracy of the "dynamic" method may be sufficient to increase the spacing between static survey stations (or possibly even to obviate the need for static survey measurements in certain applications), thereby reducing drilling time and the costs of a well twinning operation.

It will thus be understood that the invention is not limited to embodiments in which the earth's magnetic field is removed from the measured magnetic field (e.g., as described above in Equations 1 and 2). For example, the earth's magnetic field has not been removed from FIG. 5 (note that the approximately periodic variation in magnetic field strength is not centered at zero). Notwithstanding, as described above, FIG. 5 may still be utilized to determine a distance to the target well. Likewise, the artisan of ordinary skill in the art would be readily able to incorporate the earth's magnetic field into the mathematical models describe above and below such that removal of the earth's magnetic field from the measured magnetic field is not necessary.

Distance and Axial Position Determination

In the previously described exemplary embodiments of this invention, the measured magnetic field strength of the interference magnetic field vector and the axial position of the magnetic field sensors (in the twin well) relative to the target well are utilized to determine the distance between the twin and target wells. In an alternative embodiment of this invention, the magnetic field vector may be utilized to uniquely determine both the distance between the two wells and the axial position of the magnetic field sensor relative to the opposing magnetic poles imparted to the target well (referred to as a normalized axial position).

The artisan of ordinary skill in the art will readily recognize that any vector may be analogously defined by either (i) the magnitudes of first and second in-plane, orthogonal components of the vector or by (ii) a magnitude and a direction (angle) relative to some in-plane reference. Likewise, the interference magnetic field vector may be defined by either (i) the magnitudes of first and second in-plane, orthogonal components or by (ii) a magnitude and a direction (angle). In the exemplary embodiments shown below, the first and second in-plane, orthogonal components of the interference magnetic field vector are referred to as parallel and perpendicular components (being correspondingly parallel with and perpendicular to the target well). The perpendicular component is defined as being positive when it points away from the target well while the parallel component is defined as being positive when it points in the direction of increasing measured depth. Equivalently, when the magnitude and direction of the interference magnetic field are utilized, an angle of 0 degrees corresponds with the perpendicular component and therefore indicates a direction pointing orthogonally outward from the target. An angle of 90 degrees corresponds with the parallel component and therefore indicates a direction pointing parallel to the target well in the direction of increasing measured depth. The invention is, of course, not limited by such arbitrary conventions.

As described above (as well as in commonly assigned, co-pending U.S. patent application Ser. No. 11/301,762), the pattern of opposing magnetic poles imparted to the target casing string results in a measurable magnetic flux about the casing string. Moreover, as stated above, the interference magnetic field vector is uniquely related to the distance between the twin and target wells and the axial position of the magnetic field sensors relative to the opposing poles imparted to the target well. This may be expressed mathematically, for example, as follows:

$$M_N = f_1(d,l)$$

$$M_P = f_2(d,l) \qquad \text{Equation 7}$$

where $M_N$ and $M_P$ define the interference magnetic field vector and represent the magnitude of the components perpendicular (normal) to and parallel with the target well, d represents the distance between the two wells, l represents the normalized axial position of the magnetic field sensors along the axis of the target well, and $f_1(\cdot)$ and $f_2(\cdot)$ represent first and second mathematical functions (or empirical correlations) that define $M_N$ and $M_P$ with respect to d and l. In one exemplary embodiment in which the twin and target wells are substantially parallel, the magnitudes $M_N$ and $M_P$ may be determined from the x, y, and z components of the interference magnetic field vector, for example, as follows:

$$M_N = \sqrt{M_{TX}^2 + M_{TY}^2}$$

$$M_P = |M_{TZ}| \qquad \text{Equation 8}$$

where $M_{TX}$, $M_{TY}$, and $M_{TZ}$ are as defined above, for example, with respect to Equation 2. The signs (positive or negative) of $M_N$ and $M_P$ may be determined as discussed hereinabove from the direction of the interference magnetic field relative to the target well. In the more general case (where the twin and target wells are not parallel), the artisan of ordinary skill would readily be able to derive similar relationships.

The mathematical functions/correlations $f_1(\cdot)$ and $f_2(\cdot)$ (in Equation 7) may be determined using substantially any suitable techniques. For example, in one exemplary embodiment of this invention, bi-axial magnetic field measurements are made at a two-dimensional matrix (grid) of known orthogonal distances d and normalized axial positions l relative to a string of magnetized tubulars deployed at a surface location. $M_N$ and $M_P$ may then be determined from the bi-axial measurements (e.g., the first axis may be perpendicular to the target thereby indicating $M_N$ and the second axis may be parallel with the target thereby indicating $M_P$). It will be understood that $M_N$ and $M_P$ may also be determined from tri-axial magnetic field measurements, e.g., via Equation 8. Known interpolation and extrapolation techniques can then be used to determine $M_N$ and $M_P$ at substantially any location relative to the target well (thereby empirically defining $f_1(\cdot)$ and $f_2(\cdot)$). In another exemplary embodiment of this invention, $f_1(\cdot)$ and $f_2(\cdot)$ may be determined via a mathematical model (e.g., a finite element model) of a semi-infinite string of magnetized wellbore tubulars. Such a model may include, for example, pairs of opposing magnetic poles of known strength and spacing along the string.

Figure 7A:
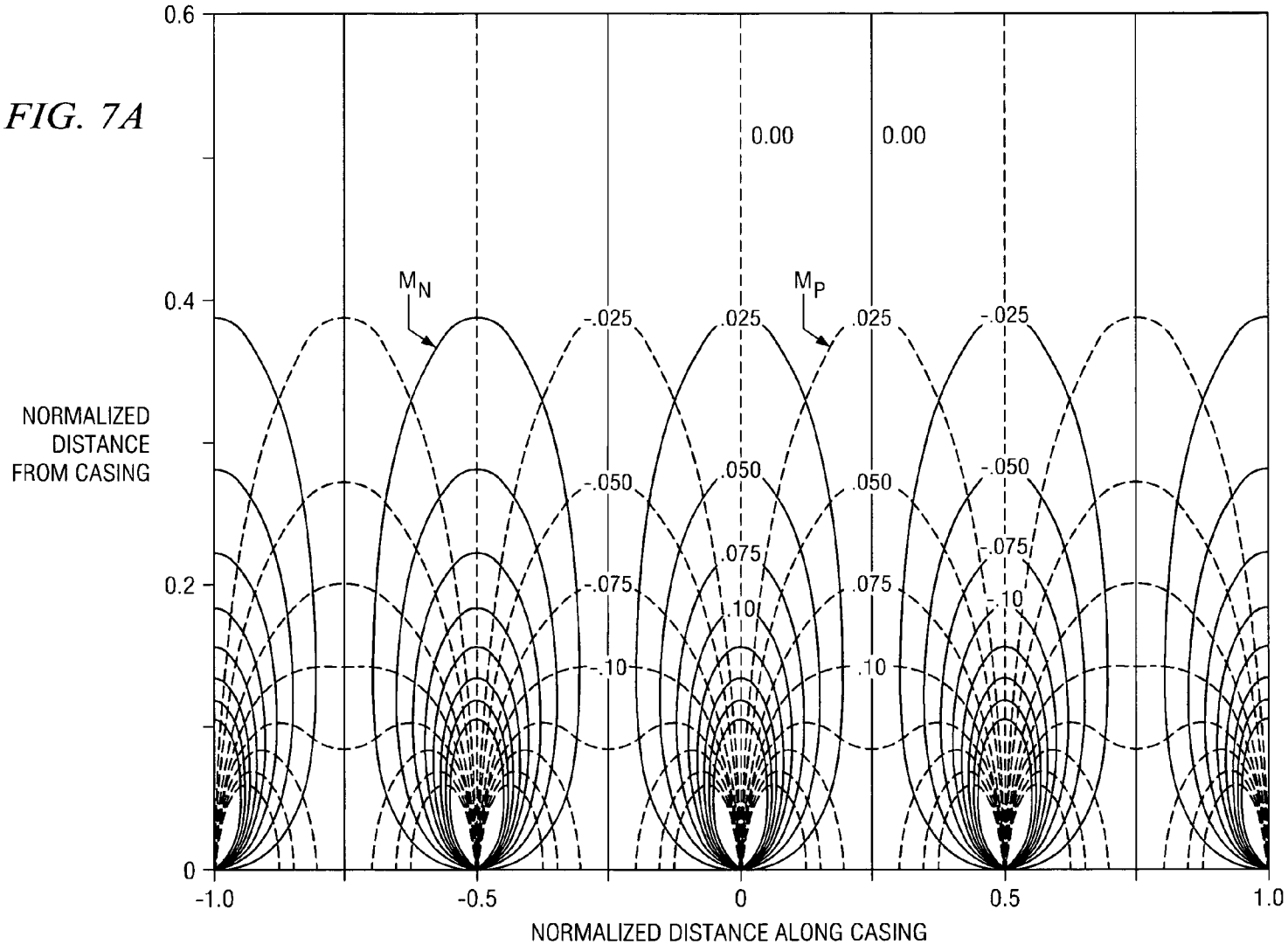
FIG. 7A depicts a dual contour plot of the magnitude M and direction $\phi$ of the interference magnetic field vector as a function of normalized distance d and axial position l along the target well.

One such dipole mathematical model is shown on FIG. 7A, which is a dual contour plot of $M_N$ (solid lines) and $M_P$ (dashed lines) plotted as a function of distance from (y-axis) and along (x-axis) the casing string. The distances are normalized to the axial spacing between adjacent NN pole pairs (which in one exemplary embodiment is twice the length of a casing joint—approximately 24 meters). A normalized distance of 0.0 (on the x-axis) represents an axial position adjacent a NN pair of opposing poles and a normalized distance of 0.5 represents an axial position adjacent a SS pair of opposing poles.

Upon measuring $M_N$ and $M_P$ (the orthogonal and parallel components of the interference magnetic field vector), d and l may be determined using substantially any suitable techniques. For example, d and l may be determined graphically from FIG. 7A using known graphical solution techniques. Alternatively, d and l may be determined mathematically, for example, via mathematically inverting Equation 7 so that:

$$d = f_3(M_N, M_P)$$

$$l = f_4(M_N, M_P) \qquad \text{Equation 9}$$

where d, l, $M_N$, and $M_P$ are as defined above and $f_3(\cdot)$ and $f_4(\cdot)$ represent mathematical functions that define d and l with respect to $M_N$ and $M_P$. It will be appreciated that substantially any known mathematical inversion techniques, including known analytical and numerical techniques, may be utilized. Equation 9 is typically (although not necessarily) solved for d and l using known numerical techniques, e.g., sequential one-dimensional solvers. The invention is not limited in these regards.

It will be appreciated that the interference magnetic field vector (as represented by $M_N$ and $M_P$ in FIG. 7A) repeats at normalized distance intervals of 1.0 along the axis of the target well. It will thus be understood that the axial position l determined above does not uniquely determine the absolute measured depth of the twin well with respect to the target well. Rather the axial position l defines the location of the magnetic field sensor within a single period (i.e. a normalized distance of 1.0) along the axis of the target well. As such, the axial position l is typically referenced with respect to the nearest NN or SS opposing poles. There is no such periodicity in the distance d determined via the various exemplary embodiments of the present invention.

As stated above, the interference magnetic field vector may be equivalently defined by the magnitude and direction (e.g., the angle with respect to the target well) of the vector. Thus, Equation 7 may be rewritten, for example, as follows:

$$M = f'_1(d,l)$$

$$\phi = f'_2(d,l) \qquad \text{Equation 10}$$

where M and $\phi$ define the interference magnetic field vector and represent the magnitude (interference magnetic field strength) and direction (the angle relative to the target well) of the vector, d represents the distance between the two wells, l represents the normalized axial position of the magnetic field sensors along the axis of the target well, and $f'_1(\cdot)$ and $f'_2(\cdot)$ represent alternative mathematical functions (or empirical correlations) that define the magnitude M and direction $\phi$ with respect to d and l. M and $\phi$ may be determined from $M_N$ and $M_P$, for example, as follows:

$$M = \sqrt{M_N^2 + M_P^2}$$

$$\varphi = \arctan\left(\frac{M_N}{M_P}\right) \qquad \text{Equation 11}$$

Figure 7B:
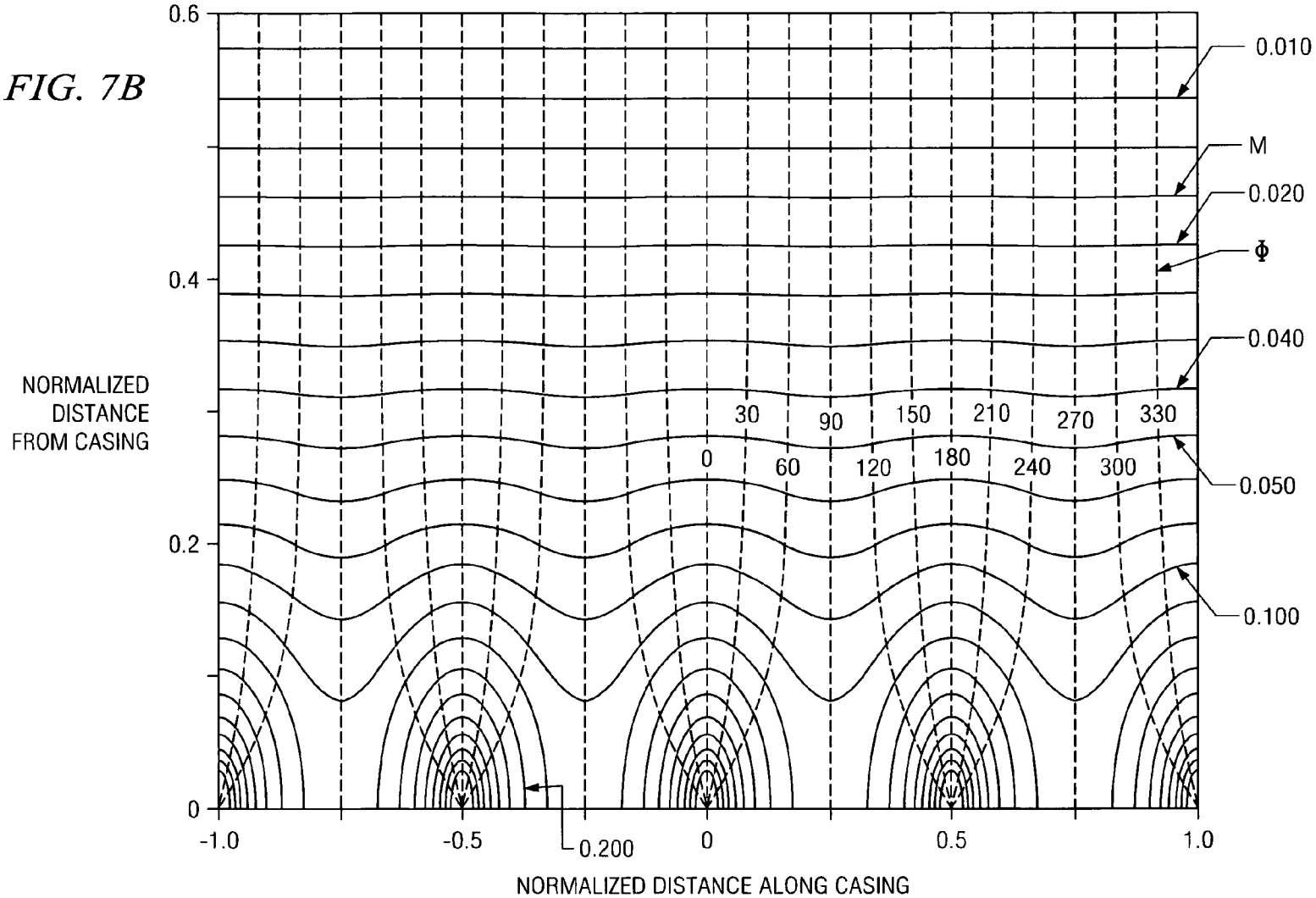
FIG. 7B depicts a dual contour plot of the magnitude of the components of the interference magnetic field vector perpendicular to and parallel with the target well as a function of normalized distance away from the target well (on the y-axis) and axial position along the target well (on the x-axis).

With reference now to FIG. 7B, a dual contour plot of M (solid lines) and $\phi$ (dashed lines) is shown as a function of normalized distances from (y-axis) and along (x-axis) the casing string. The dual contour plot of FIG. 7B was generated using the same dipole model used to generate the contour plot shown on FIG. 7A. As described above, the magnitude and direction of the interference magnetic field repeats at a normalized distance interval of 1.0 along the axis of the target well (M repeating at intervals of 0.5 and $\phi$ repeating at intervals of 1.0). As also described above, the distance d between the twin and target wells and the axial position l along the target well may be determined using any suitable techniques, for example graphically utilizing FIG. 7B and/or mathematically using the inversion techniques described above with respect to Equation 9. Use of the magnitude and direction of the interference magnetic field vector may be preferred for some drilling operations in that it tends to be more robust (stable) mathematically.

Distance Determination from the Change in Direction of the Interference Magnetic Field Vector With reference again to FIG. 7B, the distance between the twin and target wells may also be determined from the change in direction of the interference magnetic field vector between first and second axially spaced magnetic field measurements. It can be seen on FIG. 7B, at normalized distances greater than about 0.25 (for the exemplary dipole model shown), that the contours in (p are non-parallel indicating that the change in $\phi$ resulting from a change in axial position l is sensitive to the distance d between the wells. Accordingly, changes in $\phi$ between first and second axially spaced magnetic field measurements may be utilized to determine the distance d (provided that the axial spacing between measurements is known).

To further illustrate, note that at axial positions approximately adjacent to either the NN or SS opposing poles (normalized distances of about 0.0, 0.5., 1.0, etc.), $\phi$ changes more rapidly with increasing measured depth than at axial positions between the opposing poles (normalized distances of 0.25, 0.75, etc.). Accordingly, assuming that the twin well is substantially parallel with the target well (parallel with the x-axis on FIG. 7B), the distance, d, between the twin and target wells may be determined from first and second longitudinally spaced measurements of the direction, $\phi$, of the interference magnetic field. This may be expressed mathematically, for example, as follows:

$$d=f_{11}(\phi_1,\phi_2,\Delta MD)$$

$$l=f_{12}(\phi_1,\phi_2,\Delta MD) \qquad \text{Equation 12}$$

where d represents the distance between the twin and target wells (as described above), l represents the normalized axial position of the magnetic field sensors along the axis of the target well (as also described above), $\phi_1$ and $\phi_2$ represent the direction of the interference magnetic field (with respect to the target well) at the first and second measurement points, $\Delta$MD represents the difference in measured depth between the two measurement points, and $f_{11}(\cdot)$ and $f_{12}(\cdot)$ indicate that that d and l are mathematical functions of $\phi_1$, $\phi_2$, and $\Delta$MD.

The first and second magnetic field measurements (from which $\phi_1$, $\phi_2$, and $\Delta$MD are determined) may be acquired either simultaneously at first and second longitudinally spaced magnetic field sensors (e.g., spaced at a known distance along the drill string) or sequentially during drilling of the twin well. The invention is not limited in this regard. The mathematical function/correlations $f_{11}(\cdot)$ and $f_{12}(\cdot)$ may be determined empirically or theoretically, for example, in substantially the same manner as described above with respect to Equation 7 for determining $f_1(\cdot)$ and $f_2(\cdot)$. Equation 12 may then be solved via substantially any known means (e.g., graphically or numerically as also described above) to determined the distance d to that target well. One exemplary embodiment of a graphical solution is as follows: (i) a horizontal (parallel with the x-axis) segment of length $\Delta$MD is located on FIG. 7B such that the left most point of the segment (which corresponds to the first measurement point) is at an angle equal to $\phi_1$; (ii) the segment is moved along the y-axis (with the left most point remaining at $\phi_1$) until the right most point of the segment (which corresponds to the second measurement point) is at an angle equal to $\phi_2$; and (iii) the distance between the two wells is then determined from the location of the segment on FIG. 7B. It will be appreciated that the axial positions, $l_1$ and $l_2$, of the first and second measurement points may also be determined graphically from the location of the segment of FIG. 7B.

It will be appreciated that the method described above with respect to Equation 12 is not limited to the use of two axially spaced magnetic field measurements. Rather, substantially any number of measurements may be utilized. For example, a method utilizing three or more measurements having known spacing may be advantageously utilized to reduce measurement noise and thereby increase the accuracy of the distance determination. Alternatively, methods utilizing a set of three or more magnetic field measurements may be advantageously used to relax the assumptions made in deriving Equation 12 and therefore to determine other parameters of interest (e.g., an approach angle of the twin well relative to the target well). As stated above, the method described above with respect to Equation 12 inherently assumes that the twin and target wells are substantially parallel when only two magnetic field measurements are utilized. This is typically a good assumption in well twinning operations (such as SAGD operations), since the intent of the twinning operation is to drill substantially parallel wells at some fixed distance from one another. The invention, however, is not limited in this regard as scenarios arise in which the twin well may be approaching or diverging from the target well (i.e., the twin is no longer parallel with the target). In such scenarios it would generally be advantageous to determine the angle of approach (or divergence) between the two wells using three or more axially spaced magnetic field measurements.

With reference again to Equation 12, it will also be appreciated that the distance d and the axial position l may be determined independent of the interference magnetic field strength M. Accordingly, after determining d and l (as described above) the measured interference magnetic field strength may then be utilized, for example, to determine the strength of the magnetic poles imparted to the magnetized target well. The pole strengths may be determined, for example, via substituting d and l (determined via Equation 12) into Equation 10. The interference magnetic field strength M then be used to evaluate (calibrate) the model defined by $f'_1(\cdot)$, which typically includes two principle variables; (i) the spacing between opposing magnetic poles and (ii) the strength of the poles (which are assumed to be equal).

Although the present invention and its advantages have been described in detail, it should be understood that various changes, substitutions and alternations can be made herein without departing from the spirit and scope of the invention as defined by the appended claims.

We claim:

1. A method for determining a distance between a twin well and a target well, the method comprising:

(a) deploying a drill string in the twin well, the drill string including a magnetic sensor in sensory range of magnetic flux emanating from the target well, the target well being magnetized such that it includes a substantially periodic pattern of opposing north-north (NN) magnetic poles and opposing south-south (SS) magnetic poles spaced apart along a longitudinal axis thereof;

(b) measuring a magnetic field with the magnetic sensor;

(c) processing the magnetic field measured in (b) to determine a magnitude of an interference magnetic field attributable to the target well;

(d) processing the magnitude of the interference magnetic field to determine a preliminary distance to the target well;

(e) estimating an axial position of the magnetic sensor relative to at least one of the opposing magnetic poles imparted to the target well; and (f) processing the preliminary distance determined in (d) and the axial position estimated in (e) to determine a corrected distance to the target well.

2. The method of claim 1, wherein (e) further comprises processing a component of the interference magnetic field that is substantially parallel with the axis of the borehole to estimate the axial position of the magnetic field sensor with respect to the target well.

3. The method of claim 1, wherein (f) further comprises:

(i) estimating a variation in the interference magnetic field along a longitudinal axis of the drill string at the preliminary distance;

(ii) determining a local amplitude of the variation estimated in (i) at the axial position estimated in (e);

(iii) correcting the magnitude of the interference magnetic field determined in (c) to remove the local amplitude determined in (ii); and (iv) processing the magnitude determined in (c) and said corrected magnitude determined in (iii) to determine the corrected distance.

4. The method of claim 1, wherein:

the preliminary distance is determined in (d) according to the equation:

$$d_1 = a\ln(M_1) + b;\ \text{and}$$

the corrected distance is determined in (f) according to the equation:

$$d_2 = a\ln(M_2) + b;$$

wherein $d_1$ and $d_2$ represent the preliminary and corrected distances, $M_1$ represents the magnitude of an interference magnetic field vector estimated in (c), $M_2$ represents a corrected magnitude of the interference magnetic field vector, and a and b represent empirically determined fitting parameters related to said magnetization of the target well.

5. A method for estimating the distance between a twin well and a magnetized target well while drilling the twin well, the method comprising:

(a) deploying a drill string in the twin well, the drill string including a magnetic sensor in sensory range of magnetic flux emanating from the target well, the target well being magnetized such that it includes a substantially periodic pattern of opposing north-north (NN) magnetic poles and opposing south-south (SS) magnetic poles spaced apart along a longitudinal axis thereof;

(b) measuring an axial component of the magnetic flux while drilling, the axial component substantially parallel with a longitudinal axis of the twin well;

(c) processing the axial component of the magnetic flux measured in (b) to estimate a magnitude of an interference magnetic field vector attributable to the target well; and (d) processing the magnitude estimated in (c) to estimate the distance between the twin and target wells.

6. The method of claim 5, wherein the magnitude is estimated in (c) according to the equation:

$$M = \frac{M_{TZ}}{\sin\theta}$$

wherein M represents the magnitude of the interference magnetic field vector, $M_{TZ}$ represents an axial component of the interference magnetic field vector, and θ represents the axial position of the sensors with respect to the target well in angular form such that $0 \leqq \theta < 2\pi$ represents a single period along the longitudinal axis of the target well.

7. The method of claim 5, wherein the magnitude of the interference magnetic field vector is estimated graphically in (c) from a plot of the axial component of the magnetic flux versus measured depth of the twin well.

8. The method of claim 7, wherein the magnitude is substantially equal to half of a peak to trough amplitude of the axial component of the magnetic flux.

9. The method of claim 5, wherein the distance is determined in (d) according to the equation:

$$d = a\ln(M) + b$$

wherein d represents the distance between the two wells, M represents the magnitude of an interference magnetic field vector estimated in (c), and a and b represent empirically determined fitting parameters related to said magnetization of the target well.

10. A method for determining a distance between a twin well and a target well, the method comprising:

(a) deploying a drill string in the twin well, the drill string including a magnetic sensor in sensory range of magnetic flux emanating from the target well, the target well being magnetized such that it includes a substantially periodic pattern of opposing north-north (NN) magnetic poles and opposing south-south (SS) magnetic poles spaced apart along a longitudinal axis thereof;

(b) measuring a magnetic field with the magnetic sensor;

(c) processing the magnetic field measured in (b) to determine first and second components of an interference magnetic field vector attributable to the target well, the first and second components being selected from the group consisting of (i) a magnitude of the interference magnetic field vector and an angle of the interference magnetic field vector with respect to a fixed reference and (ii) magnitudes of first and second orthogonal components of the interference magnetic field vector;

(d) acquiring a model, the model relating the first and second components to (i) a distance between the magnetic field sensor and the target well and (ii) an axial position of the magnetic field sensor relative to the target well; and (e) processing the first and second components determined in (c) in combination with the model acquired in (d) to determine the distance between the magnetic field sensor and the target well.

11. The method of claim 10, wherein (e) further comprises processing the first and second components in combination with the model to determine both the distance between the magnetic field sensor and the target well and the axial position of the magnetic field sensor relative to the target well.

12. The method of claim 10, wherein the magnitude and direction of the interference magnetic field vector are determined according the following equations:

$$M=\sqrt{M_{TX}^2+M_{TY}^2+M_{TZ}^2}$$

$$\varphi = \arctan\left(\frac{\sqrt{M_{TX}^2 + M_{TY}^2}}{M_{TZ}}\right)$$

wherein M represents the magnitude of the interference magnetic field vector, $\phi$ represents the direction of the interference magnetic field vector with respect to the target well, and $M_{TX}$, $M_{TY}$, and $M_{TZ}$ represent x, y, and z components of the interference magnetic field vector.

13. The method of claim 10, wherein the first and second orthogonal components of the interference magnetic field vector are determined according the following equations:

$$M_N=\sqrt{M_{TX}^2+M_{TY}^2}$$

$$M_P=M_{TZ}$$

wherein $M_N$ and $M_P$ represent the first and second orthogonal components, and $M_{TX}$, $M_{TY}$, and $M_{TZ}$ represent x, y, and z components of the interference magnetic field vector.

14. The method of claim 10, wherein the distance is determined graphically in (e) from a dual contour plot of the first and second components plotted as a function of the distance and the normalized axial position of the magnetic field sensor relative to the target well.

15. The method of claim 10 wherein the model is an empirical model acquired in (d) is an empirical model comprising a plurality of magnetic field measurements made at a grid of locations including a plurality of distances from a magnetized casing string and a plurality of axial positions along the magnetized casing string.

16. The method of claim 10, wherein the model acquired in (d) is a theoretical dipole model including a plurality of longitudinally spaced NN and SS opposing magnetic poles.

17. The method of claim 10, wherein (e) further comprises:

(i) inverting the model such that the distance and the normalized axial position are expressed as being dependent upon the first and second components of the interference magnetic field vector;

(ii) processing said inverted model to determine the distance and the axial position.

18. The method of claim 17, wherein:

the model may be expressed mathematically as follows:

$$M=f_1(d,l)$$

$$\phi=f_2(d,l); \text{ and}$$

said inverted model may be expressed mathematically as follows:

$$d=f_3(M,\phi)$$

$$l=f_4(M,\phi)$$

wherein M and $\phi$ represent the magnitude and the direction of the interference magnetic field vector, d represents the distance, l represents the axial position; $f_1(\cdot)$ and $f_2(\cdot)$ represent the model, which relates the M and $\phi$ to d and l, and $f_3(\cdot)$ and $f_4(\cdot)$ represent the inverted model, which relates d and l to M and $\phi$.

19. The method of claim 17, wherein:

the model is expressed mathematically as follows:

$$M_N=f_1(d,l)$$

$$M_P=f_2(d,l); \text{ and}$$

said inverted model is expressed mathematically as follows:

$$d=f_3(M_N,M_P)$$

$$l=f_4(M_N,M_P);$$

wherein $M_N$ and $M_P$ represent the magnitudes of the first and second orthogonal components of the interference magnetic field vector, d represents the distance, l represents the axial position; $f_1(\cdot)$ and $f_2(\cdot)$ represent the model, which relates $M_N$ and $M_P$ to d and l, and $f_3(\cdot)$ and $f_4(\cdot)$ represent the inverted model, which relates d and l to $M_N$ and $M_P$.

20. A method for determining a distance between a twin well and a target well, the method comprising:

(a) deploying a drill string in the twin well, the drill string including a magnetic sensor in sensory range of magnetic flux emanating from the target well; the target well being magnetized such that it includes a substantially periodic pattern of opposing north-north (NN) magnetic poles and opposing south-south (SS) magnetic poles spaced apart along a longitudinal axis thereof;

(b) measuring a magnetic field at first and second longitudinally spaced locations in the borehole;

(c) processing the first and second magnetic field measurements to determine first and second directions of an interference magnetic field vector at the corresponding first and second locations;

(d) acquiring a model relating a direction of the interference magnetic field vector to a distance between the magnetic field sensor and the target well; and (e) processing the first and second directions determined in (c) and a difference in measured depth between the first and second locations with the model to determine the distance between the magnetic field sensor and the target well.

21. The method of claim 20, wherein (e) further comprises processing the first and second directions determined in (c) and the difference in measured depth with the model to determine both the distance between the magnetic field sensor and the target well and a normalized axial position of the magnetic field sensor relative to the target well.

22. The method of claim 20, wherein the distance is determined graphically in (e) from a contour plot of the direction of the interference magnetic field vector plotted as a function of the distance and the axial position of the magnetic field sensor relative to the target well.

23. The method of claim 20, wherein the model is expressed mathematically as follows:

$$d=f_{11}(\phi_1,\phi_2,\Delta MD)$$

$$l=f_{12}(\phi_1,\phi_2,\Delta MD)$$

where d represents the distance between the twin and target wells, l represents the axial position of the magnetic field sensors with respect to the target well, $\phi_1$ and $\phi_2$ represent the first and second directions of the interference magnetic field vector, $\Delta$MD represents the difference in measured depth between the two measurement points, and $f_{11}(\cdot)$ and $f_{12}(\cdot)$ represent the model, which relates d and l to $\phi_1$, $\phi_2$, and $\Delta$MD.

24. The method of claim 20, further comprising:

(f) processing the distance determined in (e) to determine a magnetic strength of the magnetic poles on the target well.

* * * * *